US007162191B2

(12) United States Patent
DiGirolamo et al.

(10) Patent No.: US 7,162,191 B2
(45) Date of Patent: Jan. 9, 2007

(54) BUFFED TONER METERING BLADE FOR USE WITH AN IMAGING APPARATUS

(75) Inventors: Martin Victor DiGirolamo, Lexington, KY (US); David Starling MacMillan, Winchester, KY (US); Jody Evan McCoy, Stanton, KY (US); Robert Francis Soto, Lexington, KY (US); Donald Wayne Stafford, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 264 days.

(21) Appl. No.: 10/815,352

(22) Filed: Apr. 1, 2004

(65) Prior Publication Data

US 2005/0220500 A1 Oct. 6, 2005

(51) Int. Cl.
*G03G 15/08* (2006.01)

(52) U.S. Cl. ..... 399/284

(58) Field of Classification Search ..... 399/274, 399/284

See application file for complete search history.

(56) References Cited

U.S. PATENT DOCUMENTS

| | | | | |
|---|---|---|---|---|
| 4,616,918 | A * | 10/1986 | Kohyama et al. | 399/284 |
| 5,232,500 | A * | 8/1993 | Kamaji et al. | 399/284 |
| 5,708,943 | A | 1/1998 | Applegate et al. | |
| 6,021,297 | A | 2/2000 | Campbell et al. | |
| 6,078,771 | A | 6/2000 | Buchanan et al. | |
| 6,360,068 | B1 * | 3/2002 | Kinoshita et al. | 399/284 |
| 6,697,594 | B1 | 2/2004 | Murphy et al. | |

* cited by examiner

*Primary Examiner*—William J. Royer
(74) *Attorney, Agent, or Firm*—Ronald K. Aust

(57) ABSTRACT

A doctor blade for use with an imaging apparatus includes an elongated member, and a metering surface formed on a portion of the elongated member. The metering surface has surface features, which are modified by buffing the metering surface.

14 Claims, 5 Drawing Sheets

BUFFED TONER METERING BLADE FOR USE WITH AN IMAGING APPARATUS

BACKGROUND OF THE INVENTION

1. Field of the Invention

The present invention relates to a device that aids in improving the quality of images formed with an imaging apparatus, and, more particularly, to a doctor blade for use with an imaging apparatus.

2. Description of the Related Art

An electrophotographic imaging apparatus, such as a laser printer, forms a latent image on a photoconductor member, such as a photoconductive drum, which in turn is developed by the application of toner to the photoconductor member. The electrophotographic imaging apparatus typically uses a developer roll to carry toner to the photoconductor member.

A doctor blade is used to meter the amount of toner that is to be carried by the developer roll to the photoconductor member, and ideally produces a thin, uniform layer of toner on the developer roll. For example, as the developer roll rotates, the developer roll carries toner to the doctor blade, which is spring biased into pressing engagement with the developer roll. The pressure that is generated in a nip between the doctor blade and developer roll causes the formation of a layer of toner on the developer roll, which in turn is carried to the photoconductor member.

Some known doctor blades used to meter toner have a coated metering surface. The coated metering surface, however, tends to be a rough, irregular surface. It has now been realized that such a rough, irregular surface for the metering surface of the doctor blade is prone to toner filming, due to the formation of toner agglomeration sites. When a sufficiently large amount of toner has agglomerated onto the metering surface, a resistive layer is formed, and thus, the toner charge is adversely impacted. As a result, toner may be developed in unintended places on the photoconductor member, resulting in background printing, such as in the form of a gray background, or streaks, on the print media, such as paper.

Also, the toner agglomerations at the metering surface of the doctor blade may be formed in irregular patterns, which in turn prevents a uniform toner layer from being formed on the developer roll, thereby resulting in streaks that are visible in the printed image.

What is needed in the art is a doctor blade, for use with an imaging apparatus, that is configured to reduce or eliminate toner filming on its metering surface, while promoting a uniform toner flow to the developer roll.

SUMMARY OF THE INVENTION

The present invention provides a doctor blade, for use with an imaging apparatus, that is configured to reduce or eliminate toner filming on its metering surface, while promoting a uniform toner flow to the developer roll.

The invention, in one form thereof, relates to a doctor blade for use with an imaging apparatus. The doctor blade includes an elongated member, and a metering surface formed on a portion of the elongated member. The metering surface has surface features, which are modified by buffing the metering surface.

In another form thereof, the invention relates to a method of configuring a doctor blade for use with an imaging apparatus, including the steps of providing an elongated member; applying a coating on at least a portion of the elongated member to form a metering surface, the coating defining surface peaks on the metering surface; and buffing the metering surface to truncate the surface peaks.

In still another form thereof, the present invention relates to a cartridge for use in an imaging apparatus. The cartridge includes a developer roll, and a doctor blade positioned in pressing engagement with the developer roll. The doctor blade has a buffed metering surface.

In still another form thereof, the invention relates to an imaging apparatus, including a print engine and a cartridge configured for mounting on the print engine. The cartridge includes a developer roll, and a doctor blade positioned in pressing engagement with the developer roll. The doctor blade has a buffed metering surface.

An advantage of the present invention is that toner filming on the metering surface of the doctor blade is reduced or eliminated.

Another advantage is that uniform toner flow to the developer roll may be promoted.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
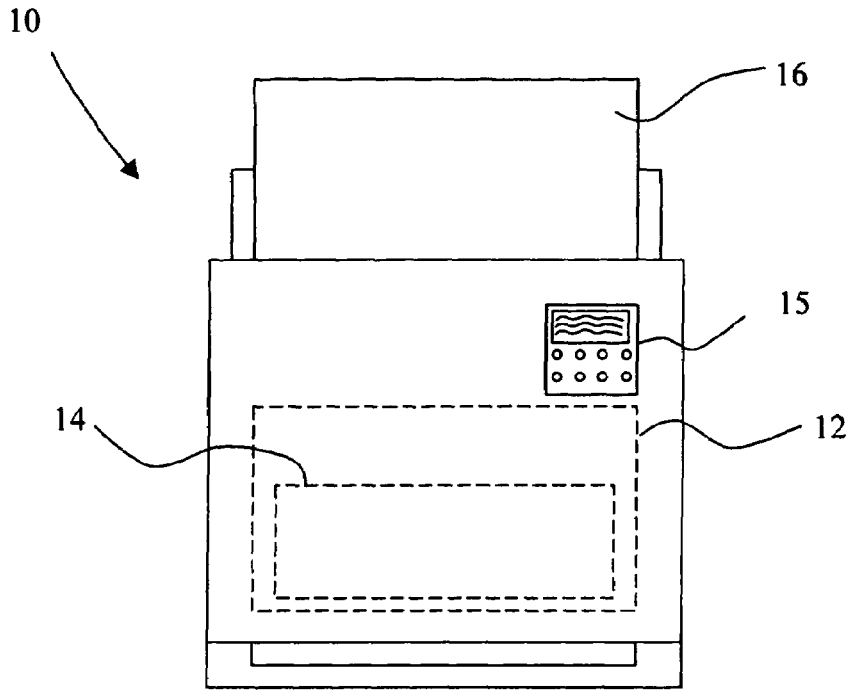
FIG. 1 is a diagrammatic depiction of an imaging apparatus that utilizes an imaging cartridge configured in accordance with the present invention.

Referring now to the drawings and particularly to FIG. 1, there is shown an imaging apparatus 10 having a print engine 12 that utilizes an imaging cartridge 14. Imaging cartridge 14 is configured for mounting on print engine 12. A user interface 15 is provided to allow a user local access to control, and retrieve information from, imaging apparatus 10. When attached to a computer (not shown), imaging apparatus 10 may be controlled via the computer.

Imaging apparatus 10 may be, for example, a printer or a multifunction unit. Such a multifunction unit may be configured to perform standalone functions, such as copying or facsimile receipt and transmission, in addition to printing. Print engine 12 may be, for example, an electrophotographic print engine, which includes, for example, a charging source for applying an electrical charge to a photoconductor member, and a light source, such as a laser, used to selectively discharge areas on the photoconductor member to form a latent image on the photoconductor member. The latent image on the photoconductor member is developed using toner supplied by imaging cartridge 14, and in turn, is transferred to a sheet of print media 16 that is fed through a sheet feed path of imaging apparatus 10.

Figure 2:
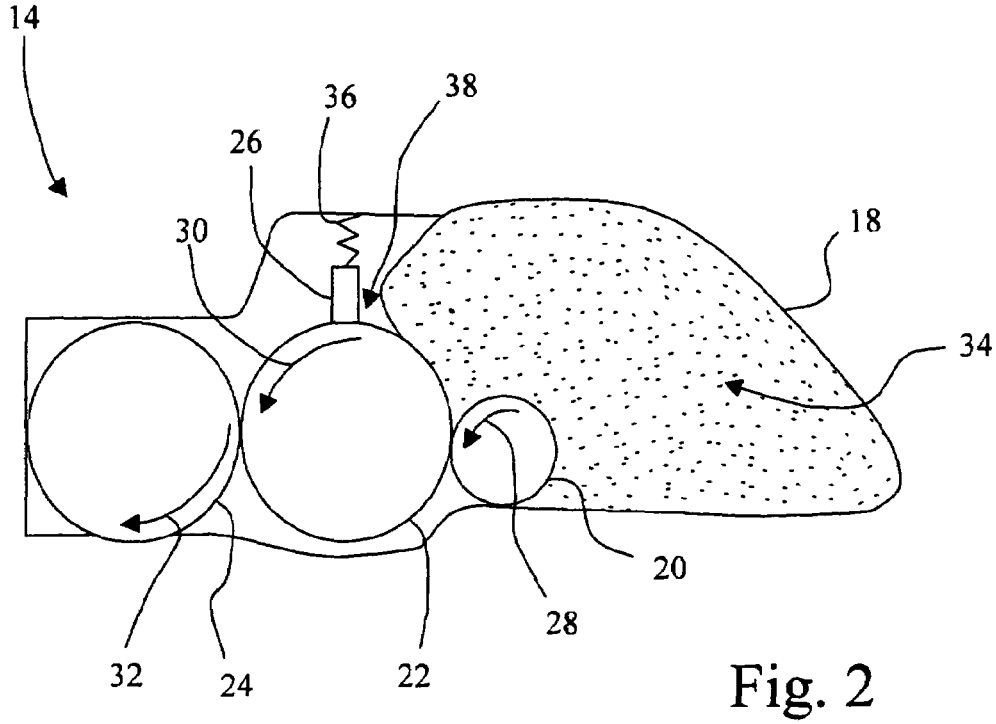
FIG. 2 shows a simplified diagrammatic representation of one embodiment of the imaging cartridge of FIG. 1, including a doctor blade configured in accordance with the present invention.

FIG. 2 shows a simplified diagrammatic representation of one embodiment of imaging cartridge 14. As shown, imaging cartridge 14 includes a toner sump 18, a toner adder roll 20, a developer roll 22, a photoconductive drum 24, and a doctor blade 26 fabricated in accordance with the present invention. The directional arrows 28, 30, 32 depict a direction of rotation of each of toner adder roll 20, developer roll 22, and photoconductive drum 24, respectively. Toner sump 18 includes a supply of toner 34, represented by dots in toner sump 18. Doctor blade 26 is biased in pressing engagement with developer roll 22 via a spring member 36.

During operation, toner 34 is coated onto developer roll 22 by toner adder roll 20. As developer roll 22 rotates, developer roll 22 carries toner 34 to doctor blade 26, which is pressed against developer roll 22 by spring member 36. The pressure that is generated in a nip 38 between doctor blade 26 and developer roll 22 causes the formation of a layer of the toner 34 that is then carried by developer roll 22 to photoconductive drum 24, where a latent image previously formed on a surface of photoconductive drum 24 by imaging apparatus 10 is then developed by a transfer of toner 34 from developer roll 22 to photoconductive drum 24.

Figure 3:
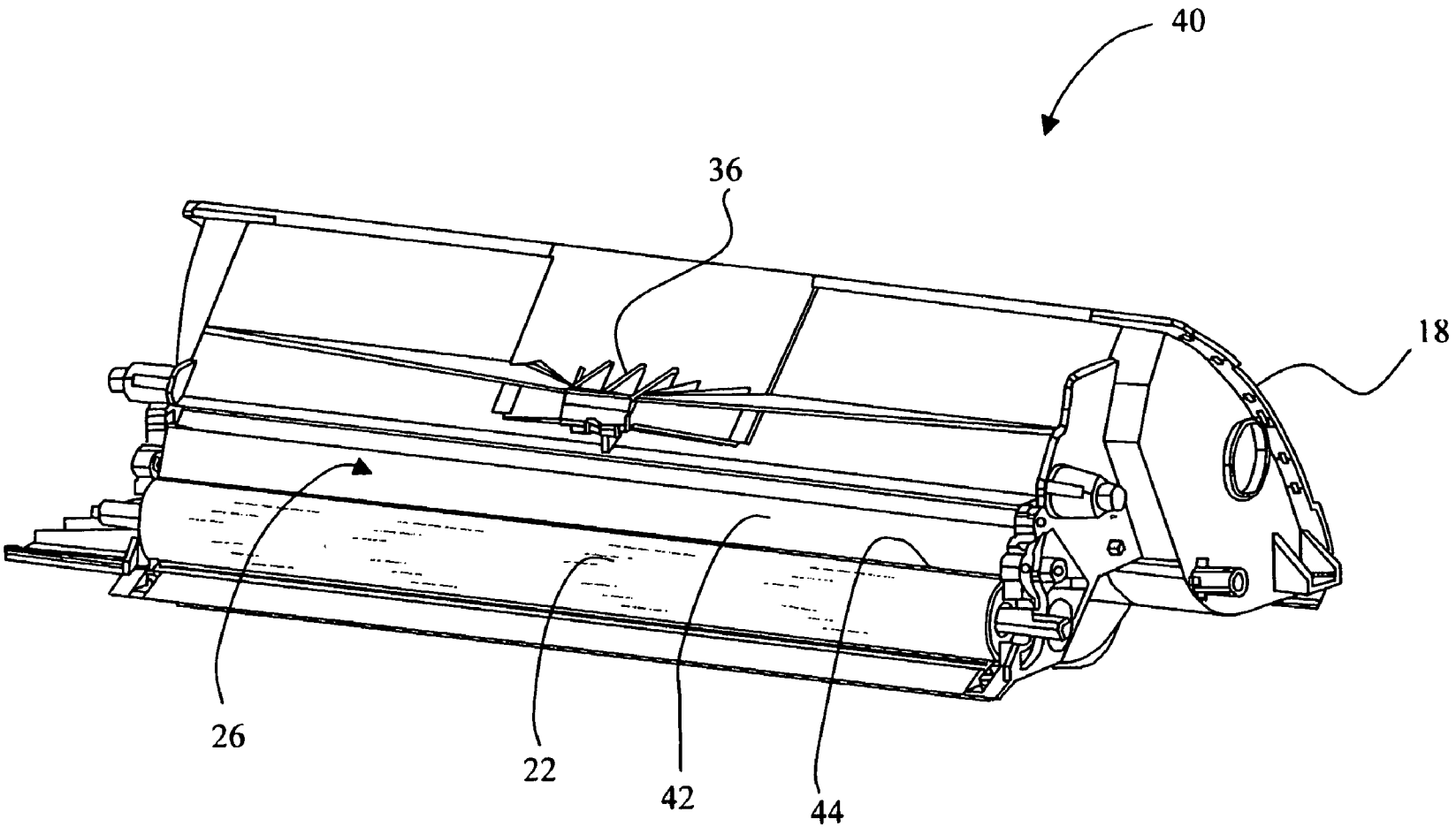
FIG. 3 is a perspective view of a toner cartridge, which is separable from a photoconductive drum of the imaging cartridge, and which includes a doctor blade configured in accordance with the present invention.

Referring to FIG. 3, some embodiments of imaging cartridge 14 of FIG. 2 may include a toner cartridge 40, shown in a perspective view, which is separable from photoconductive drum 24. In the embodiment shown in FIG. 3, toner cartridge 40 is configured as an integral, and separately replaceable, unit. Toner cartridge 40 may include, for example, toner sump 18, toner adder roll 20, developer roll 22, doctor blade 26 and spring member 36.

Figure 4:
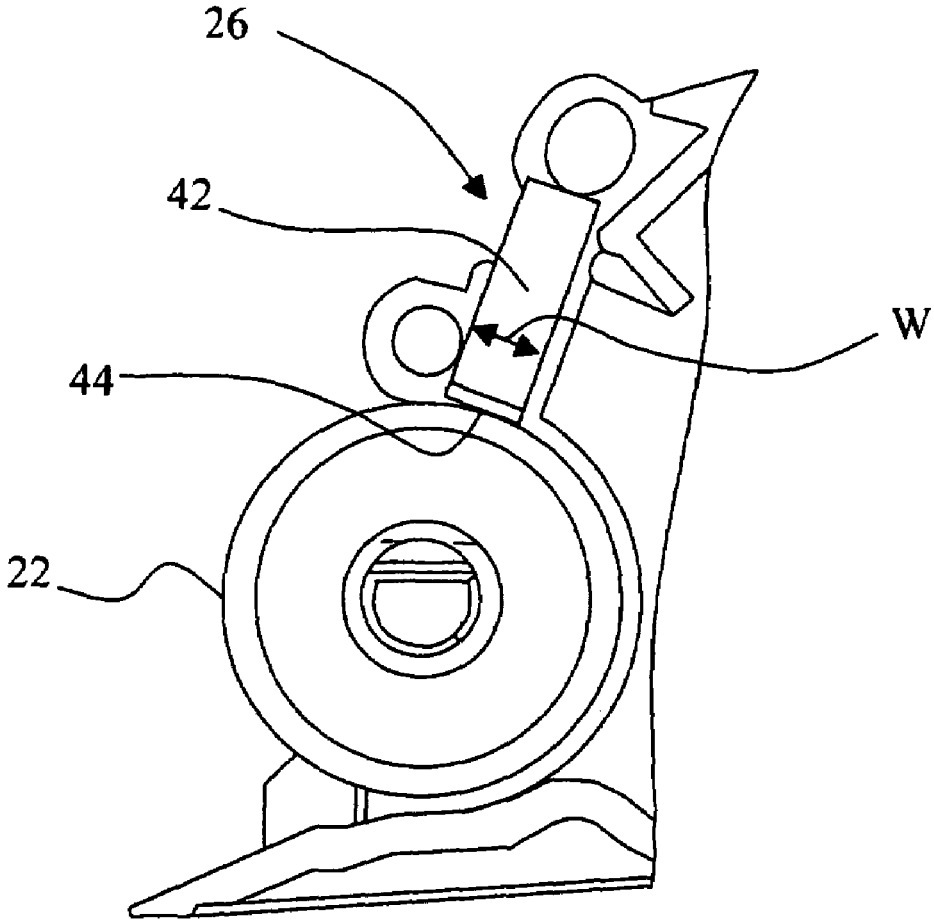
FIG. 4 is a side view of an enlarged broken out portion of the toner cartridge of FIG. 3.

FIG. 4 is a side view of a portion of toner cartridge 40, showing in greater detail the engagement of doctor blade 26 with developer roll 22. Referring to FIGS. 3 and 4, it is shown that doctor blade 26 includes an elongated member 42 and a metering surface 44. Elongated member 42 serves as a base for metering surface 44, and may be formed as a beam that will extend parallel to developer roll 22. For example, elongated member 42 may be made of metal, such as steel, and may be nickel-plated to resist corrosion. Metering surface 44 of doctor blade 26 is formed on a portion of elongated member 42 by applying a metering surface coating, which may be, for example, a tungsten carbide layer. The metering surface coating defines surface features of metering surface 44, which may be modified in accordance with the present invention. Metering surface 44 has a width W, which may be, for example, about four millimeters.

In accordance with the present invention, doctor blade 26 is configured to reduce or eliminate toner filming on metering surface 44, while promoting a uniform toner flow to developer roll 22. The process of configuring doctor blade 26 in accordance with the present invention will be described with reference to FIGS. 5A–5C and 6A–6C.

Figure 5A:
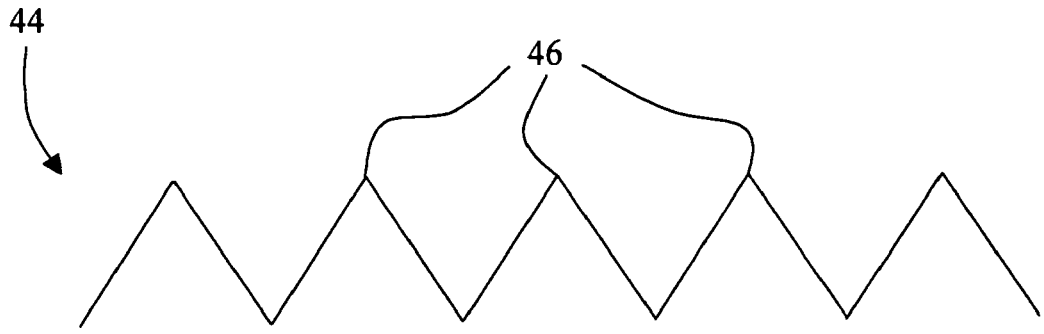
FIG. 5A diagrammatically illustrates a metering surface of a doctor blade prior to any buffing.
Figure 5B:
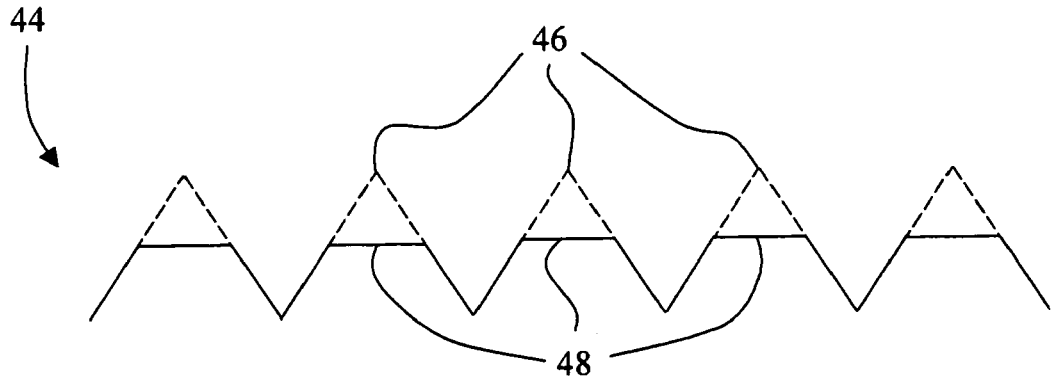
FIG. 5B diagrammatically illustrates a metering surface of a doctor blade having undergone linear buffing.
Figure 5C:
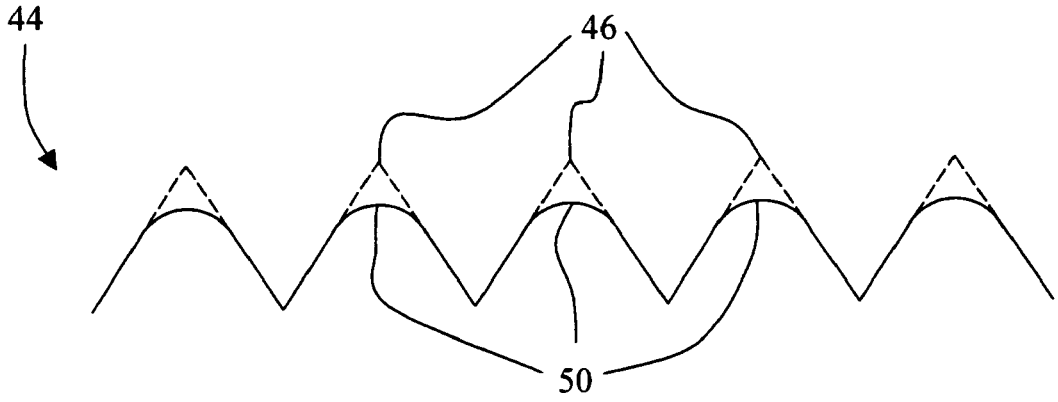
FIG. 5C diagrammatically illustrates a metering surface of a doctor blade having undergone orbital buffing.
Figure 6A:
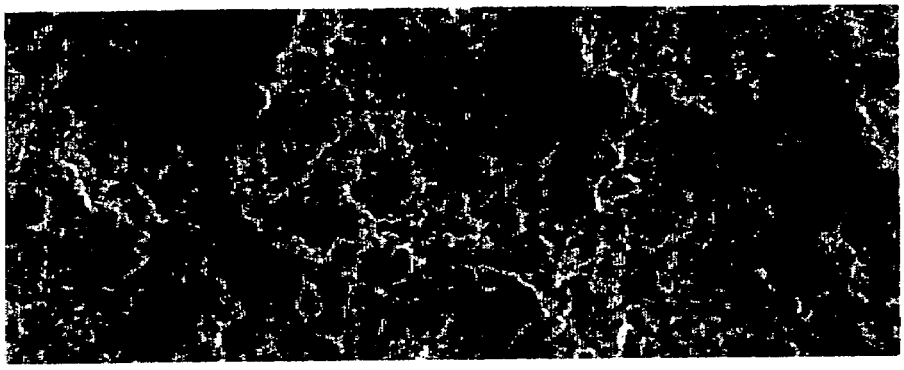
FIG. 6A illustrates via a magnified photographic view, associated with FIG. 5A, the metering surface of the doctor blade prior to any buffing.
Figure 6B:
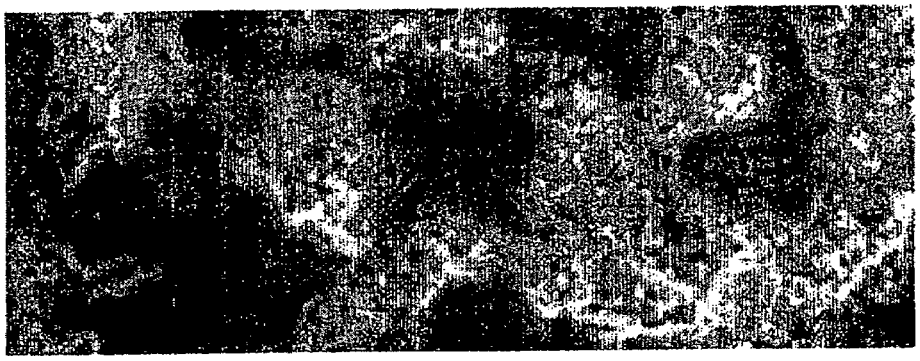
FIG. 6B illustrates via a magnified photographic view, associated with FIG. 5B, the metering surface of the doctor blade having undergone linear buffing.
Figure 6C:
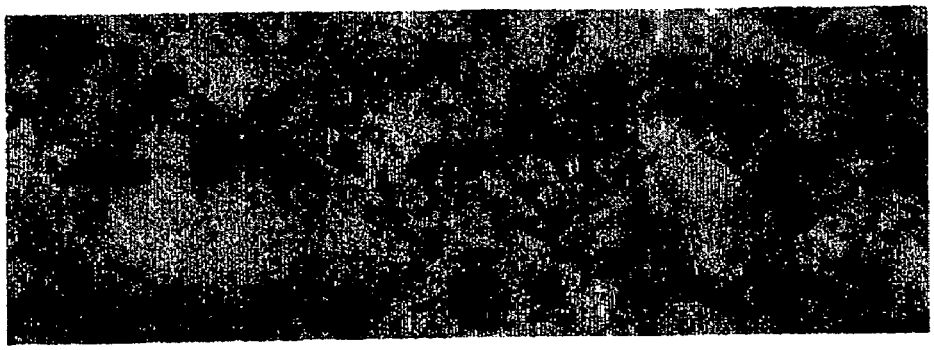
FIG. 6C illustrates via a magnified photographic view, associated with FIG. 5C, the metering surface of the doctor blade having undergone orbital buffing.

FIGS. 5A–5C diagrammatically illustrate, respectively: surface features of metering surface 44 prior to any buffing (FIG. 5A); surface features of metering surface 44 with metering surface 44 having undergone linear buffing (FIG. 5B); and surface features of metering surface 44 with metering surface 44 having undergone orbital buffing (FIG. 5C). FIGS. 6A–6C illustrate via magnified photographic views, respectively: surface features of metering surface 44 prior to any buffing (FIG. 6A); surface features of metering surface 44 with metering surface 44 having undergone linear buffing (FIG. 6B); and surface features of metering surface 44 with metering surface 44 having undergone orbital buffing (FIG. 6C). The level of magnification of metering surface 44 depicted in FIGS. 6A–6C is times 1000.

Referring to FIGS. 5A and 6A, it has been realized that toner will tend to adhere to the surface peaks 46 of metering surface 44, in the absence of any buffing. To avoid toner filming, i.e., toner adhesion, to metering surface 44, it has been found to be beneficial to remove the sharp surface peaks 46, which form the agglomeration sites for the toner. In accordance with the present invention, the removal of sharp surface peaks 46 will be achieved by buffing metering surface 44.

As illustrated in FIGS. 5B and 6B, as a result of linear buffing of metering surface 44, the surface peaks 46 are truncated and toner agglomerations are less likely to occur. However, it has been found that the linear buffing method may have some limitations. More particularly, the linear buffing used to reduce or eliminate filming of metering surface 44 of doctor blade 26 may cause excessive toner flow to developer roll 22, since a surface roughness of metering surface 44 may be reduced too much due to the forming of flats 48 on metering surface 44 as a result of the linear buffing. In other words, metering surface 44 may become too smooth.

As illustrated in FIGS. 5C and 6C, as a result of orbital buffing of metering surface 44, the surface peaks 46 also are truncated and toner agglomerations are less likely to occur. However, it has been found that the orbital buffing method has advantages over the linear buffing method. More particularly, in the orbital buffing method, the surface peaks are truncated and rounds 50 are formed because the orbital buffing media polishes in multiple axes, e.g., at least two axes, and in multiple directions, e.g., at least two directions. This surface profile including rounds 50 reduces the likelihood of toner filming of metering surface 44 through toner agglomerations, and yet maintains an amount of surface roughness desirable to maintain a proper amount of toner flow to developer roll 22.

The orbital buffing method may be implemented, for example, using a orbital sander, such as a Porter Cable™ Model 340(K) Finishing Sander, operating at about 14,000 revolutions per minute, with an orbit diameter of about $1/16_{th}$ of an inch (about 1.58 millimeters), and with a buff time of about 15 seconds. The orbital buffing media may be, for example, a Scotch-Brite™ 7447B general purpose hand pad available from 3M Company.

To facilitate an automated process in practicing the present invention, a machine table may be arranged to hold and transport doctor blade 26 during the buffing of metering surface 44 with respect to the orbital buffing media, and wherein the orbital sander is positioned at a predetermined orientation with respect to metering surface 44 during the buffing process. Such an automated system may be controlled, for example, using a PLC (programmable logic controller) program executing on a programmable controller.

While this invention has been described with respect to particular embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A doctor blade for use with an imaging apparatus, comprising:

an elongated member; and a metering surface formed on a portion of said elongated member, said metering surface having surface features which are modified by buffing said metering surface, said buffing being performed by orbital buffing of said metering surface to modify said surface features by rounding, said orbital buffing of said metering surface occurring at about 14,000 revolutions per minute, and having an orbit diameter of about 1.58 millimeters.

2. A doctor blade for use with an imaging apparatus, comprising:

an elongated member; and a metering surface formed on a portion of said elongated member, said metering surface having surface features which are modified by buffing said metering surface, wherein said buffing of said metering surface occurs in at least two directions.

3. A doctor blade for use with an imaging apparatus, comprising:

an elongated member; and a metering surface formed on a portion of said elongated member, said metering surface having surface features which are modified by buffing said metering surface, wherein said metering surface is tungsten carbide.

4. The doctor blade of claim 3, wherein said elongated member is made of metal.

5. A method of configuring a doctor blade for use with an imaging apparatus, comprising the steps of:

providing an elongated member;

applying a coating on at least a portion of said elongated member to form a metering surface, said coating defining surface peaks on said metering surface; and buffing said metering surface to truncate said surface peaks.

6. The method of claim 5, wherein the buffing step comprises orbital buffing of said metering surface.

7. The method of claim 6, said orbital buffing of said metering surface occurring at about 14,000 revolutions per minute, and having an orbit diameter of about 1.58 millimeters.

8. The method of claim 5, wherein said buffing occurs in at least two directions.

9. The method of claim 5, wherein said coating is tungsten carbide.

10. The method of claim 5, wherein said elongated member is made of metal.

11. A cartridge for use in an imaging apparatus, comprising:

a developer roll; and a doctor blade positioned in pressing engagement with said developer roll, said doctor blade having a buffed metering surface, said buffed metering surface having surface features that were modified by orbital buffing, said orbital buffing of said buffed metering surface occurring at about 14,000 revolutions per minute, and having an orbit diameter of about 1.58 millimeters.

12. The cartridge of claim 11, said cartridge being one of an imaging cartridge including a photoconductive member and a toner cartridge that does not include said photoconductive member.

13. An imaging apparatus, comprising:

a print engine; and a cartridge configured for mounting on said print engine, said cartridge including a developer roll; and a doctor blade positioned in pressing engagement with said developer roll, said doctor blade having a buffed metering surface, said buffed metering surface having surface features that were modified by orbital buffing, said orbital buffing of said buffed metering surface occurring at about 14,000 revolutions per minute, and having an orbit diameter of about 1.58 millimeters.

14. The imaging apparatus of claim 13, said cartridge being one of an imaging cartridge including a photoconductive member and a toner cartridge that does not include said photoconductive member.

* * * * *